United States Patent [19]

Isao

[11] 4,305,173

[45] Dec. 15, 1981

[54] DUST CATCHING DEVICE

[76] Inventor: Suzuki Isao, 4-6-13, Kudan-minami, Chiyoda ku, Tokyo, Japan, 102

[21] Appl. No.: 79,583

[22] Filed: Sep. 27, 1979

[30] Foreign Application Priority Data

Oct. 23, 1978 [JP] Japan ..... 53-145509[U]

[51] Int. Cl.[3] ..... A47L 13/40

[52] U.S. Cl. ..... 15/1.5 A; 15/226

[58] Field of Search ..... 15/1.5, 209 R, 210 R, 15/226, 229; 300/21

[56] References Cited

U.S. PATENT DOCUMENTS

| | | | |
|---|---|---|---|
| 180,913 | 8/1876 | Patterson | 15/226 |
| 259,807 | 6/1882 | Brown | 15/226 |
| 1,003,008 | 9/1911 | Pugh | 15/229 R |
| 2,948,003 | 8/1960 | Tamsberg | 15/1.5 A |

FOREIGN PATENT DOCUMENTS

| | | | |
|---|---|---|---|
| 517427 | 2/1953 | Belgium | 15/226 |
| 350764 | 7/1937 | Italy | 15/229 AC |

*Primary Examiner*—Edward L. Roberts

*Attorney, Agent, or Firm*—Eric P. Schellin

[57] ABSTRACT

A dust catching device according to this invention comprises a dust catching body which is constructed by shuttling in a zigzag form a certain number of split yarns made of synthetic resin or synthetic fibers bundled in a form of a string so as to form a predetermined width. The string has properties of electrifiability or electrostatic chargeability, whereby it has dust attracting power. Warps are woven into the strip of split yarns or fibers formed in the above mentioned manner at both ends as well as two places near the center of the strip, and the woven strip is cut in two along the center line thereof in parallel with the warps. The woven warps are then removed near the center line so as to obtain two continuous, right and left, dust catching bodies. The dust catching device according to this invention is further constructed by tightly coiling the dust catching bodies spirally around a handle stick from one end of the bodies to the other end consecutively, cutting the bodies at desired places, fixing both ends thereof on the handle stick by pins, winding a vinyl tape on the final end and covering the tape with a cover.

4 Claims, 4 Drawing Figures

DUST CATCHING DEVICE

BACKGROUND OF THE INVENTION

1. Field of the Invention

This invention concerns a cleaning device equipped with a dust catching means made of synthetic resin split yarns or synthetic fibers at the end of a handle stick which is most suitably used to clean such difficult-to-clean places as furniture, ornaments, ceilings or walls, showcases, show windows or displays of stores or for cleaning inside and outside of automobiles.

The dust catching device according to this invention provides an effective cleaning device which can very hygienically clean such places that electric vacuum cleaners do not reach without scattering dust or dirts around by utilizing dust attracting power caused by electrostatic property of the dust catching means.

2. Description of the Prior Art

It is well known that vacuum cleaners, as popular and prevailing as they are today, are not all purpose cleaners. That is supported by the fact that traditional type dusters are still in active use. However, traditional dusters are unsanitary as they scatter dust and dirt in the atmosphere when in use. Woolen dusters, one of the conventional dusters, for instance, do not have dust attracting property in wool itself which is coiled around a handle stick and merely provide incomplete cleaning by dusting off dust or dirt which are only to be cleaned from floor surface later by vacuum cleaners. It requires after-disposal of dust and additional labour as well as trouble. Woolen dusters are not washable when they are soiled. Further, they do not stand for long term use since woolen pieces tend to come out or to be motheaten. Moreover, prices for such woolen dusters are relatively high.

Feather dusters comprising bird feathers attached around a handle stick have almost similar drawbacks as the woolen dusters.

SUMMARY OF THE INVENTION

Accordingly, it is an object of this invention to eliminate drawbacks of conventional and traditional dusters by providing a dust catching device which is easily operative and simply constructed at low cost and which, further, is able to clean such places that vacuum cleaners cannot reach or which are difficult to clean without scattering dust and dirt. It is another object of this invention to provide a dust catching device which can replace vacuum cleaners so as to save precious energy.

This invention can attain the abovementioned objects by providing a dust catching device which comprises dust catching means made of synthetic resin split yarn or synthetic fiber tightly coiled around on one end of a handle stick and fixed at predetermined length. The objects of this invention are also achieved by utilizing electro-static property caused by said dust catching means in attracting and collecting dust and dirt thereon.

BRIEF DESCRIPTION OF THE DRAWING

The accompanying drawings show an embodiment of dust catching device according to this invention wherein.

DETAILED DESCRIPTION OF THE PREFERRED EMBODIMENTS

Figure 1:
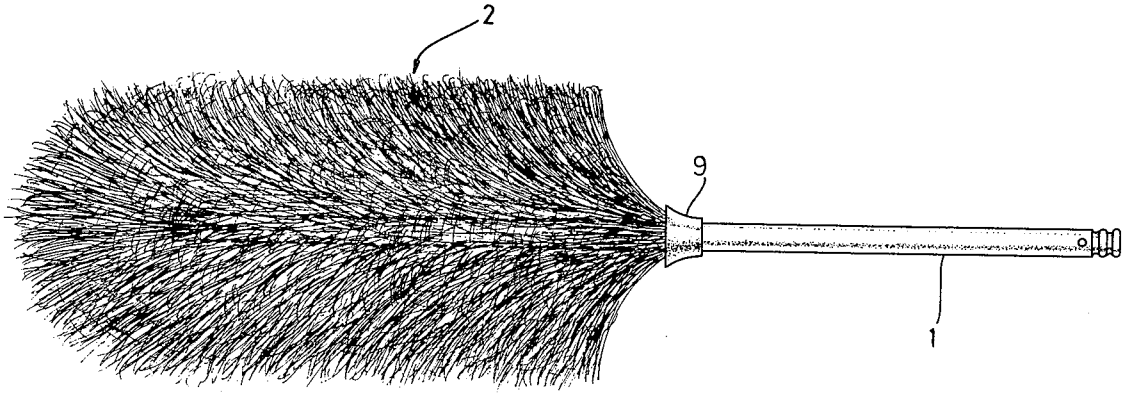
FIG. 1 is a frontal view.
Figure 2:
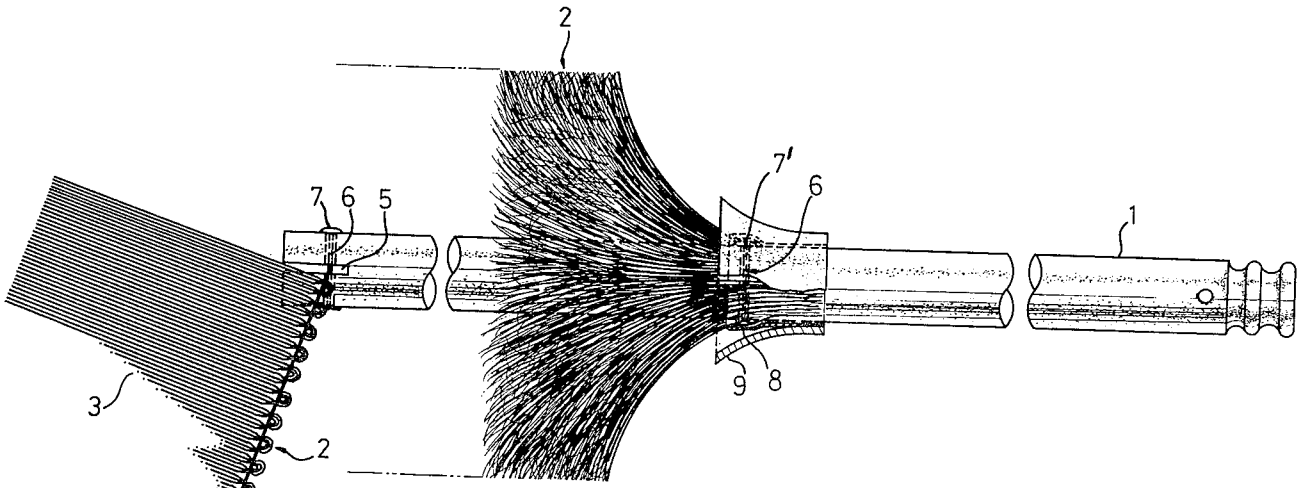
FIG. 2 is a schematic view to show how to coil dust catching means around a handle stick of the dust catching device.

This invention will be described in further detail referring to an embodiment shown in the accompanying drawings hereinafter. In FIG. 1, the reference number 1 denotes a stick handle, the material of which is selected from such suitable materials as bamboo, wood, hard resin or others. The length thereof is determined by specific purposes and, in a case where a particularly long handle is required, it may be constructed telescopically like a handle of an umbrella. The number 2 denotes a dust catching means or body which replaces pieces of cloth or vinyl, or feather dusting pieces used in conventional dusters. This dust catching means 2, as shown in FIG. 2, comprises split yarn 3 made of synthetic resin of a suitable length, which yarns are bundled in the manner of a string and which are woven by warps at one end in order to prevent the split yarn 3 from loosening or unbinding. The dust catching means 2 is further manufactured in a manner described below.

Figure 4:
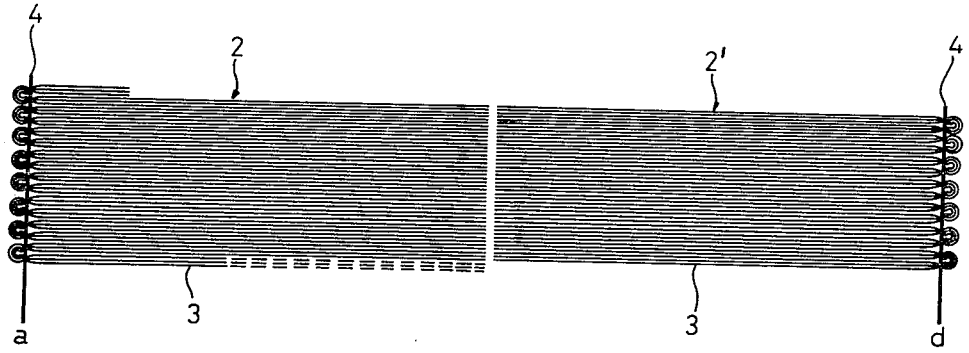
FIGS. 3 and 4 are views to show the manufacturing process of the dust catching means.
Figure 3:
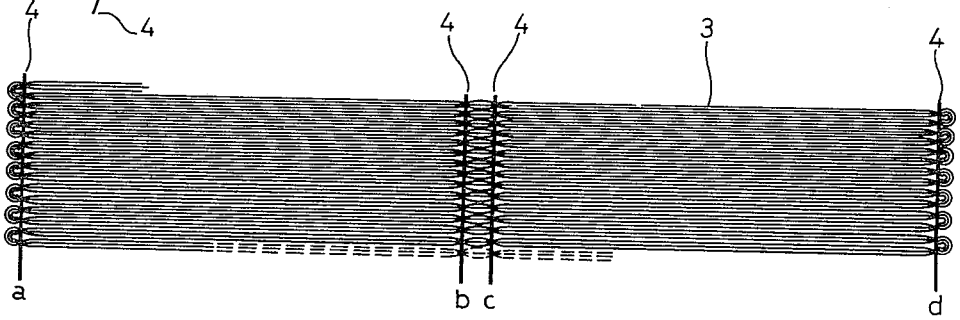

In FIG. 3, the bundled split yarn 3 in a form of the string made of synthetic fibers, comprises wefts or main yarn woven with warps 4 (weaving yarns) at both ends and at a position close to the center "a" to "d", as shown in the figure, and it is continuously woven toward the direction of warp. The woven ribbon of split yarns is cut along the center line of the weft 3 parallel to the warp 4. By drawing out the warp 4 at positions "b" and "c", a pair of symmetrical dust catching or bodies 2 and 2' are obtained as shown in FIG. 4.

As a material for the weft 3 of the dust catching means 2, split yarns made of polypropylene is preferred, whereas in a conventional duster, synthetic fiber in a tape-like form is used, and more particularly in the present invention crimp-processed polypropylene split yarns are most appropriate because they are electrostatically most active compared to other materials.

No materials more suitable than the above have been found so far. Its superiority is described below.

(1) Since one single split yarn comprises a fine flexible and strong fiber in a form of a net, when a certain number of yarns are bundled to form a string, it still keeps flexibility and strength so as not to become torn off during use. Thus, it has most desirable property as a dust catcher.

(2) It simplifies manufacturing process because there is no need to divide and split the end portion of the yarn to make it capillary, whereas in the case of the tape-like material, it must be split minutely.

(3) Polypropylene has a better property to generate static electricity than other synthetic resin materials for split yarns. The present invention utilizes such a property so that the duster cleans the dust and dirt thoroughly. Particularly, crimped split yarns have such stronger dust attracting property than split yarns that it attains its purposes by lightly brushing the surface to be cleaned rather than by vigorously sweeping, rubbing, or beating the same as in the case of traditional dusters.

(4) It is washable in detergent and it dries quickly since polypropylene has an outstanding resistance against chemicals and a drip-dry property. Further, it can shake off dust caught thereby by shaking the same at windows unless it becomes excessively dirty.

(5) It is easy to clean and it does not exhaust users because it is light in weight. This is particularly desirable for a stick type cleaner.

(6) Its specific gravity is 0.9, which is smaller than other similar materials and the price for raw material fiber is low, thereby keeping the price for the manufactured products within reasonable range.

Dust catching means made of synthetic resin split yarn or polypropylene split yarn could be replaced by dust catching means made of synthetic fibers to achieve almost similar effect.

As a material for the warp 4, filament yarns or spun yarns made of nylon, polypropylene, ester and the like are used.

The dust catching device according to this invention is improved further by replacing said dust catching means with electrifiability with dust catching means with electrochargeability, thereby increasing the dust attracting power and achieving much better cleaning effect.

Said dust catching means with electro-chargeability is manufactured, for instance, in the case of synthetic resin split yarns, by corona charging pellets of raw material after it is transformed into film form. Succeeding splitting and crimping processes are exactly the same as those in the case of said split yarns with electrifiability.

The dust catching means 2 made of a material as described above is coiled around a stick handle in the following manner. As shown in FIG. 2, the dust catching means 2 is placed on a handle 1 so as to locate the split yarn portion 3 near the dusting end portion of said handle 1 and the warp 4 is tightly coiled around said handle 1 continuously from the dusting end portion toward the handle end portion thereof. In order to prevent said dust catching means from slipping off from the said handle 1, a slit 5 is provided at the end of the handle 1 to sustain the tip of the warp 4 in said slit 5. At the end portion of said handle 1 a locking hole 6 is bored on said handle in the direction perpendicular to said slit 5 so as to fix or lock the warp 4 after it has been coiled around the handle for a few times by a pin 7 inserted into said locking hole 6.

The dust catching device 2 is cut when the dust catching device 2 of a predetermined length is coiled around the handle as described above, and the catching means near the finishing end portion is fixed by a pin 7' just as in the case of the tip end and secured by a piece of vinyl friction tape. As constructed above, it can prevent loosening up of the dust catching means 2 and stop the electrostatic effect from reaching to the handle portion. The portion wound by the vinyl friction tape 8 is covered with a cover 9. (FIGS. 1 and 2).

As described above in detail, the dust catching means according to the present invention can clean and collect dust and dirt in a far more sanitary manner than conventional cloth-strip-type dusters by taking advantage of the electrostatic or chargeable effect. Further, it provides practical merits such as a simple construction, an easy operation, and a low manufacturing price. Moreover, it is very simple to clean the dust catching device in accordance with the present invention when it becomes dirty.

By making the width narrower, the dust catching means used in this invention is effectively applicable as a dust catching means for other cleaning devices such as floor mop, hand mop, brush or cleaning or dusting devices for exhaust fans a cooler, heater or ventilator and others.

What is claimed:

1. A dust catching device, comprising:

a handle;

a continuous strip of dust catching means made of crimped synthetic resin split weft yarns having electrostatic property;

said yarns being tightly coiled around said handle; and said coiled strip of split yarns being cut at a desired length and fixed on said handle.

2. A dust catching device as in claim 1, wherein:

polypropylene split-and-crimp-processed yarn which has outstanding electrostatic property compared with other fibers or yarns is used as the material for the weft yarn of the dust catching means.

3. A dust catching device as in claim 1, wherein:

the yarn comprises a corona charged synthetic resin split yarn so as to gain chargeability.

4. A dust catching device as claimed in claim 1, wherein:

a slit is provided on one end of the handle;

an end portion of the dust catching means being received in the slit;

a hole bored in the end of the handle in a direction perpendicular to the slit;

a pin inserted into the hole to fix the end portion of the dust catching means therein in order to prevent the dust catching means from coming loose from the handle;

said dust catching means being cut after a predetermined length thereof has been spirally coiled around the handle;

the other end portion of the strip being fixed on the handle in spaced relation to said end portion at said one end of the handle;

the fixed portions of the strip being tightly bound by vinyl tape for insulating purposes; and a cover covering the tape.

* * * * *